US007320227B2

(12) United States Patent
Bellander

(10) Patent No.: US 7,320,227 B2
(45) Date of Patent: Jan. 22, 2008

(54) REFRIGERATOR WITH A SEPARATE INSULATED COMPARTMENT PROVIDED WITH A DRAIN PIPE

(76) Inventor: Wanja Bellander, Toravägen 6, S-139 40 Värmdö (SE)

( * ) Notice: Subject to any disclaimer, the term of this patent is extended or adjusted under 35 U.S.C. 154(b) by 608 days.

(21) Appl. No.: 10/399,820

(22) PCT Filed: Oct. 18, 2001

(86) PCT No.: PCT/SE01/02280

§ 371 (c)(1),
(2), (4) Date: Apr. 22, 2003

(87) PCT Pub. No.: WO02/35163

PCT Pub. Date: May 2, 2002

(65) Prior Publication Data

US 2004/0040337 A1 Mar. 4, 2004

(30) Foreign Application Priority Data

Oct. 23, 2000 (SE) ..... 0003835

(51) Int. Cl.
*F25D 21/14* (2006.01)
*F25D 11/02* (2006.01)

(52) U.S. Cl. ..... 62/441; 62/285

(58) Field of Classification Search ..... 62/285, 62/288, 289, 291, 372, 371, 457.2, 441, 447, 62/331, 440
See application file for complete search history.

(56) References Cited

U.S. PATENT DOCUMENTS

| | | | | |
|---|---|---|---|---|
| 2,465,107 | A | 3/1949 | Mascioli et al. | |
| 2,681,972 | A | 6/1954 | Holland | |
| 3,078,688 | A * | 2/1963 | Petkwitz | 62/159 |
| 3,858,409 | A * | 1/1975 | Besing | 62/285 |
| 4,207,753 | A * | 6/1980 | Shueh et al. | 62/285 |
| 4,627,246 | A * | 12/1986 | Wilson | 62/285 |
| 4,843,835 | A * | 7/1989 | Goetz et al. | 62/285 |
| 5,216,900 | A * | 6/1993 | Jones | 62/457.2 |
| 5,241,835 | A * | 9/1993 | Ascone | 62/372 |
| 5,388,427 | A * | 2/1995 | Lee | 62/331 |

FOREIGN PATENT DOCUMENTS

| | | |
|---|---|---|
| DE | 1081031 | 5/1960 |
| GB | 662064 | 11/1951 |

* cited by examiner

*Primary Examiner*—Chen Wen Jiang
(74) *Attorney, Agent, or Firm*—Frishauf, Holtz, Goodman & Chick, P.C.

(57) ABSTRACT

A refrigerator is provided which includes at least one separate, thermally well-insulated and cooled compartment. A drain pipe is provided in the compartment to drain condensation water which forms when a heated food storage container cools in the compartment.

4 Claims, 1 Drawing Sheet

REFRIGERATOR WITH A SEPARATE INSULATED COMPARTMENT PROVIDED WITH A DRAIN PIPE

CROSS-REFERENCE TO RELATED APPLICATION

This application is a U.S. National Phase Application under 35 USC 371 International Application PCT/SE01/02280 filed Oct. 18, 2001.

FIELD OF THE INVENTION

The present invention relates to a refrigerator.

BACKGROUND OF THE INVENTION

In connection with cooking it often occurs that heated food has to be cooled down and placed in a refrigerator as soon as possible in order to avoid deterioration of cooked food.

This is usually carried out such, that the hot receptacle in which the food has been cooked, or a receptacle to which the cooked, hot food has been transferred, is placed in cold water to be cooled down to a temperature permitting the receptacle to be placed in a refrigerator without exposing the food kept in the refrigerator to warming or to be affected by condensed damp. During colder seasons the receptacle may, of course, as an alternative, be placed out-doors to be cooled down.

A number of inconveniences are obvious with a procedure like that. A receptacle with food in a water-bath may be forgotten and will quite soon assume room-temperature followed by the risk of growth of bacterial content in the food contained in the receptacle. Placing out-doors is an impractical emergency solution that may result in the receptacle being forgotten till next day with an increasing outdoor temperature. Further, it may possibly occur that the food is cooked by an early eating family member and is left on the table to be consumed later by family members that are more delayed than planned, in which case the food possibly may have become uneatable.

OBJECT OF THE INVENTION

The object of the invention is to achieve a practical and efficient solution of the mentioned problem.

SUMMARY OF THE INVENTION

This is made possible, according to the invention, by equipping the interior space of the refrigerator with at least one separate, thermally well-insulated and cooled compartment with a drain pipe for draining of condensation-water from the compartment. Hence, it is possible to place a warm food receptacle or container in the compartment without affecting the food in the other part of the refrigerator. Due to the heat introduced into the compartment a heavy condensation of damp occurs initially in the compartment, which is drained in the form of condensation-water through a drain pipe in a manner known per se. The compartment should suitably contain a support surface that can stand the heat from the warm receptacle placed in the compartment. To initially reduce the cooling down time the compartment may also suitably contain a holder for fixedly holding at least one temporarily introduced freeze pack.

Figure 1:
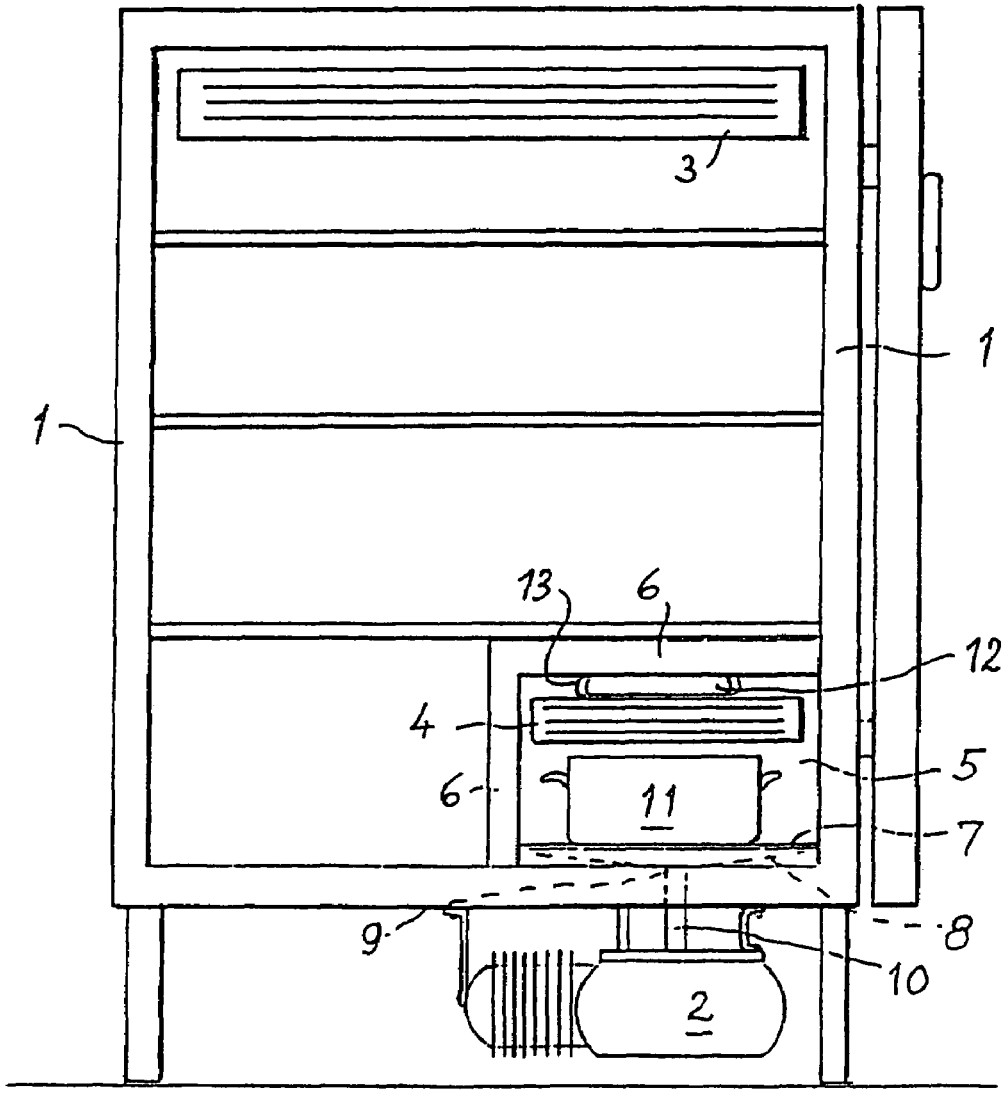
FIG. 1 schematically show a front view of an embodiment of a refrigerator according to the present invention with a completely opened door.

The refrigerator shown in FIG. 1 is essentially a conventional compressor refrigerator with a cabinet 1 containing insulation. A compressor 2 drives a cooling circuit comprising a first evaporator 3 in the usual interior space, and a second evaporator 4 in a separate storage compartment 5 provided with an efficient thermal insulation 6 in the walls of the compartment between the other part of the refrigerator and the storage compartment 5. The storage compartment 5 has a heat resistant bottom surface 7 with grooves 8 sloping down towards an opening 9 for collecting condensation-water which may form, and which is drained through a pipe 10 connected to the opening. The pipe is arranged to drain the condensate in the usual way to the top of the compressor for evaporation of the condensate by the heat generated by the compressor and its drive motor. A receptacle 11 is placed on the bottom surface 7 for being cooled down. The condenser forming a part of the cooling-circuit is, as usual, placed at the rear wall of the refrigerator and is not shown in FIG. 1.

DETAILED DESCRIPTION

When no receptacle is placed in the compartment 5 it can, of course, be utilized in the same way as the rest of the space in the refrigerator for storage of food. When a receptacle has to be cooled it is placed in the compartment 5 which, if necessary, has to be cleared by rearrangement of food. When the door of the refrigerator is closed also the compartment 5 becomes closed, resulting in that the receptacle is cooled to the usual refrigerator temperature at the same time as condensate is formed, that is drained through the pipe 10.

The invention is, of course, not limited to the embodiment shown and described here but may be modified in various ways within the scope of the invention defined by the patent claims. Hence, the refrigerator may be operated with another type of cooling process, and an improved initial cooling may be achieved by introduction of at least one frozen freeze pack 12, which may be inserted in a holding device 13 for instance in the roof of the compartment 5. The compartment 5 may also as an alternative be designed to be closed by a separate door.

The invention claimed is:

1. A refrigerator comprising:

a cooled interior food storage space;

at least one separate, thermally insulated compartment which is cooled to approximately a same temperature as the food storage space, and which is smaller than the food storage space;

a cooling circuit comprising a first evaporator in the food storage space and a second evaporator in the separate, thermally insulated compartment; and a drain pipe provided in the separate, thermally insulated compartment to drain condensation water which forms when a heated food storage container cools in the compartment.

2. The refrigerator according to claim 1, wherein the at least one separate, thermally insulated compartment comprises a heat-resistant surface for supporting a hot object.

3. The refrigerator according to claim 2, wherein the at least one separate, thermally insulated compartment comprises a holder for holding a removable frozen freeze pack.

4. The refrigerator according to claim 1, wherein the at least one separate, thermally insulated compartment comprises a holder for holding a removable frozen freeze pack.

* * * * *